US005804108A

United States Patent [19]

Wilkinson

[11] Patent Number: 5,804,108

[45] Date of Patent: Sep. 8, 1998

[54] PROCESS FOR THE PREPARATION OF CARBON FIBER

[76] Inventor: Kenneth Wilkinson, 1010 Glenwood Blvd., Waynesboro, Va. 22980

[21] Appl. No.: 742,200

[22] Filed: Oct. 31, 1996

[51] Int. Cl.[6] ..... D01F 9/22

[52] U.S. Cl. ..... 264/29.2; 264/182; 264/184; 264/210.6; 264/210.8; 264/211.14; 264/211.17; 264/233; 264/236; 423/447.4

[58] Field of Search ..... 264/29.2, 182, 264/184, 210.6, 210.8, 211.14, 211.17, 233, 236; 423/447.4

[56] References Cited

U.S. PATENT DOCUMENTS

| | | | |
|---|---|---|---|
| 4,536,448 | 8/1985 | Ogawa et al. | 264/29.2 X |
| 5,281,477 | 1/1994 | Nakatani et al. | 428/367 |
| 5,364,581 | 11/1994 | Wilkinson | 264/182 |
| 5,462,799 | 10/1995 | Kobayashi et al. | 428/364 |

*Primary Examiner*—Leo B. Tentoni
*Attorney, Agent, or Firm*—Leander F. Aulisio

[57] ABSTRACT

A process for preparing high strength carbon fiber from PAN-fiber wherein the time of the oxidation step is reduced from 30–90 minutes to about 8–15 minutes and product prepared therefrom.

8 Claims, 4 Drawing Sheets

DIFFERENTIAL THERMAL ANALYSIS (in Air)

Ⓕ = FUSION TEMPERATURE

DIFFERENTIAL THERMAL ANALYSIS

PROCESS FOR THE PREPARATION OF CARBON FIBER

BACKGROUND OF THE INVENTION

The present invention relates to a process for producing a high quality carbon fiber. More specifically the invention relates to a rapid oxidation step for improving the efficiency and economics of carbon fiber production from PAN-fibers. A herein disclosed improved PAN-fiber allows for swift oxidation while minimizing temperature surges within the fiber and spreading heat release over a longer time.

Carbon fibers prepared from acrylonitrile polymers and copolymers by a rapid oxidation process have superior physical properties such as increased tensile strength. The fibers are useful as reinforcement materials in automobile, aerospace, recreational and various other industries. An increasing demand for strong lightweight materials insures an expanded use of carbon fibers in the future. Thus a need exists for a process which insures that the starting materials for producing carbon fibers are of the finest quality. A fine quality acrylonitrile polymer or copolymer has no defects such as voids formed when gases are expelled during fiber preparation. Also the fiber should not contain more than traces of metal contaminants, as these tend to degrade the fiber. The fiber should have a round shape for maximum stiffness.

Carbon fibers, which have heretofore been used as reinforcing material for plastic composite compositions, are preferably characterized by high tensile strength, high-rigidity and a homogeneous fibrous structure. These characteristics can be adversely affected by certain properties found in the acrylonitrile copolymer feedstocks. If these undesirable properties can be identified and removed, then the final carbon fiber product is greatly enhanced in desirable characteristics.

Polyacrylonitrile (PAN)-based carbon fibers are produced in a process comprising three steps. A relatively low temperature heat treatment or oxidation step is followed by a carbonization step. The third step is an optional high temperature heat treatment. During the first step of oxidative heat treatment, a well-oriented ladder polymer structure is developed under tension.

The oxidation step is critical to the development of a high strength carbon fiber material. Prior to this step, the PAN-fibers are frequently stretched by 100% to 500% at a temperature of about 100° C. The stretching improves the alignment in the polymer structure and reduces the fiber diameter, as well as increasing the tensile strength and Young's modulus of the final carbon fiber.

In the past, the oxidation step has been conducted for a time of about 1 to about 5 hours. The step is slow and adds significant expense to the overall process. Process temperatures must be maintained below the fusion temperature of the fibers to prevent instantaneous temperature surges within the fiber. Temperature surges produce bubbles of gaseous products which ruin the physical properties of the carbon fiber. The oxidation step is conducted in an oxidizing atmosphere, usually air, at a temperature of about 190° C. to about 280° C. The reaction is an exothermic one, and a runaway reaction is always possible.

The carbonization step which follows the oxidation step is performed rapidly in an inert atmosphere at a temperature of about 1000° C. to about 2000° C. Tensile strength of the fiber reaches a maximum in this step.

U.S. Pat. No. 5,462,799 discloses the preparation of a carbon fiber wherein a precursor PAN-fiber is oxidized, carbonized and if necessary graphitized to make the carbon fiber of specified surface oxygen concentration, specified surface concentration of hydroxyl groups and specified surface concentration of carboxyl groups.

U.S. Pat. No. 5,281,477 discloses the preparation of a carbon fiber having high tenacity and high modulus of elasticity. Pretreated fibers are passed through a first carbonization zone, a second carbonization zone and a third carbonization zone.

SUMMARY OF THE INVENTION

Accordingly, an object of the present invention is to provide a process for rapidly and economically producing a high quality carbon fiber product.

It is another object of the present invention to provide a product comprising an acrylonitrile copolymer which is substantially free of metal ions and sulfonic acid groups. The product is further characterized by being prepared from acrylonitrile in an amount of about 95% to about 98% based on weight; and vinyl carboxylic acid monomer in an amount sufficient to retain in the copolymer ammonium ion or amine catalyst in amounts of about 1% to about 4% based on molar ratio, and, optionally, a vinyl carboxylic acid ester monomer in an amount up to about 2% based on weight.

These and other objects have now herein been attained by a process which includes a rapid oxidation stage wherein a specified PAN-fiber is employed. The fiber undergoes, under oxidation conditions, a rapid crosslinking at both the intramolecular level and intermolecular level. Rapid crosslink allows for swift increase in temperature without detrimental side effects that would damage the fiber.

DETAILED DESCRIPTION OF THE INVENTION

Figure 1:
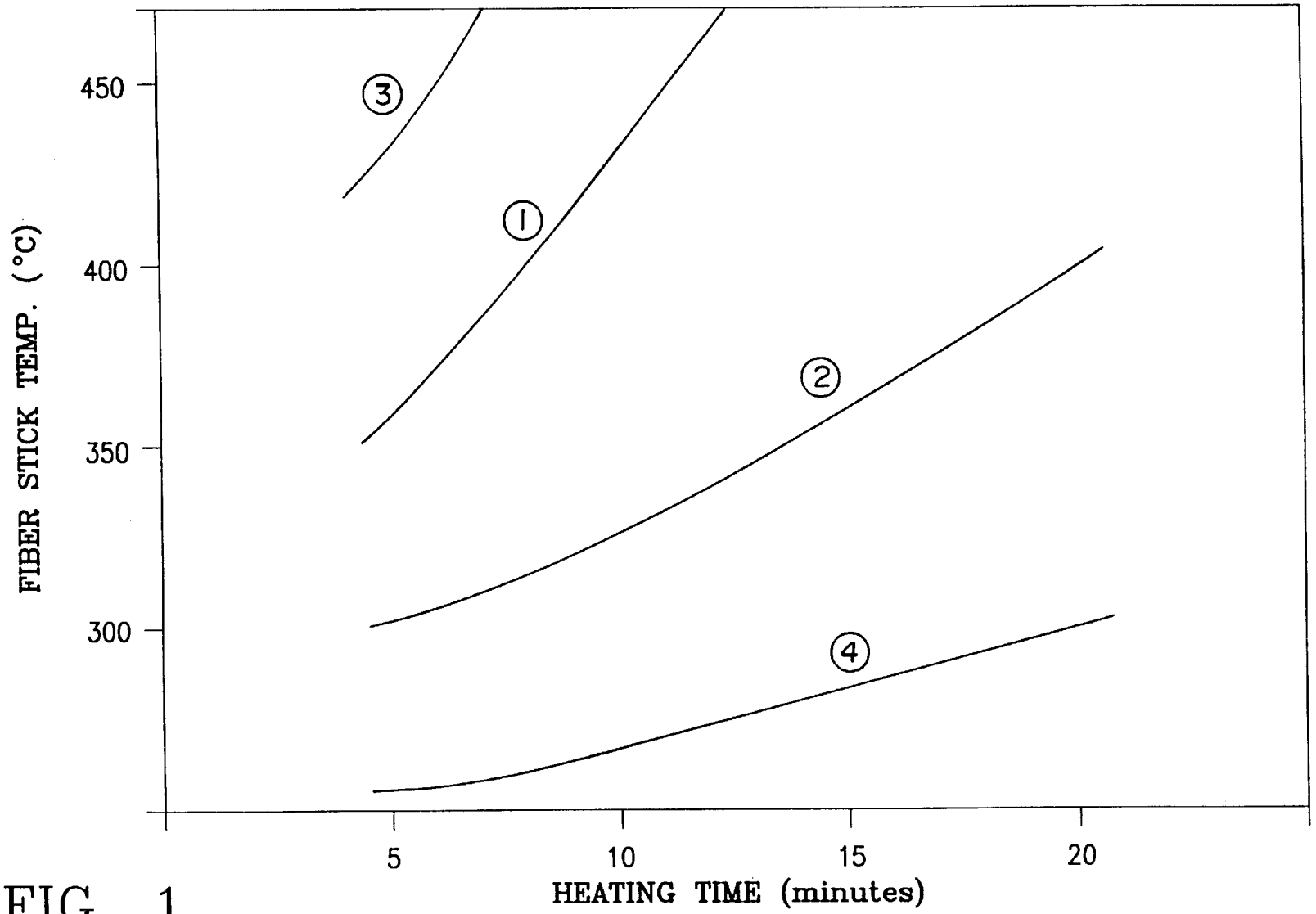
FIG. 1 is a graphical representation comparing sticking temperatures of four separate PAN-fibers.

The process of the present invention provides for preparation of carbon fiber of high tenacity from acrylonitrile copolymer fiber having improved characteristics. The process includes a rapid oxidation step at high temperature which is made possible by formation of crosslinks in the copolymer to raise the fusion temperature.

The crosslinking is catalyzed by ammonia or low molecular weight amines. The nitrogen-containing catalyst reacts with pendant cyano groups on the PAN-copolymer to cyclize the cyano groups intramolecularly and also to crosslink molecular chains. With the increase in crosslinking, the softening point of the fiber increases. The fiber can then be heat treated at higher temperatures, following at several degrees below the fusion temperature. A rapid oxidation process requires a rapid increase in crosslinking.

Process temperatures during the heat treatment or oxidation step cannot exceed the fusion temperatures of the fiber.

If temperatures exceed the fusion temperatures at any point in the process, the internal temperature of the fiber surges in a matter of seconds to over 450° C. Gaseous products are released nonuniformly to diminish the physical properties of the fiber.

It has been discovered that fusion temperatures can be rapidly increased upon oxidation when the PAN-copolymer starting material is tailored to meet specific requirements. The copolymer contains more free carboxylic acid groups which would increase retention of ammonia or amine catalysts. Neutral monomers, which slow down the oxidation reaction, are reduced to a minimum. Examples of neutral monomers are methyl and ethyl carboxylates. The copolymer is substantially free of metal ions and of groups which retain metal ions, other than the necessary carboxylic acid groups. An example of a group which retains metal ions is the sulfonic acid group. Thus vinyl sulfonic acid should not be employed as a comonomer when the polyacrylonitrile copolymer is prepared.

Any polymerization process can be employed to prepare the polyacrylonitrile copolymer. The process can be solution polymerization, a slurry process or the like, and as such forms no part of the present invention. Initiators employed in the process can be azo-type compounds, Re-dox catalysts or the like. In a preferred embodiment, a precipitation polymerization is conducted, as is disclosed in U.S. Pat. No. 5,364,581 and incorporated herein by reference.

The feedstock for the precipitation polymerization comprises a major amount of acrylonitrile monomer and a minor amount of a vinyl carboxylic acid comonomer. In a preferred embodiment, the acrylonitrile monomer is present in the feedstock in an amount from about 85% by weight to about 99% by weight. In a most preferred embodiment, the acrylonitrile monomer is present in an amount from about 92% by weight to about 98% by weight.

The vinyl carboxylic acid comonomer is a member selected from the group consisting of itaconic acid, acrylic acid and methacrylic acid. It is within the scope of the present process to use more than one comonomer. In addition to carboxylic acid-containing comonomers, other olefinic monomers can also be present. The only restriction imposed on the present process is that a vinyl sulfonic acid comonomer, allyl sulfonic acid comonomer, salts thereof, and the like cannot be included in the feedstock compositions. It has been observed that the presence of sulfonic acid groups in the final acrylonitrile copolymer causes retention of metal ions. The feedstock for use in the present process must be substantially free of sulfonic acid groups. By substantially free of sulfonic acid groups is meant not more than 0.5 mole % sulfonic acid groups based on the polymer composition. Also, when sulfonic acid groups are replaced by carboxyl groups in the final acrylonitrile copolymer, the oxidation rate during carbon fiber preparation is increased.

If precipitation polymerization is employed, the fibers can be immediately subjected to wet spinning without any pretreatment. Wet spinning is preferred because it yields round fibers which give better physical properties to the final carbon fiber. If wet spinning is performed, care must be taken to avoid the use of metal or metal-ion containing solvents. Aqueous sodium thiocyanate and aqueous zinc chloride should not be employed in the wet-spinning process. Examples of preferred solvents for wet spinning are dimethyl sulfoxide, dimethylformamide, dimethylacetamide, tetramethylene cyclic sulfone, aqueous ammonium thiocyanate and aqueous ethylene carbonate.

The oxidation catalyst, which can be added to the acrylonitrile copolymer either before the wet spinning operation or after wet spinning, must be free of metal or metal ions. The oxidation catalyst is a member selected from the group consisting of ammonia and low molecular weight primary or secondary amine. By low molecular weight amine is meant a $C_1$ to $C_6$ aliphatic amine.

A PAN-fiber prepared according to the specifications herein disclosed allows for a rapid oxidation step in the preparation of carbon fiber. The temperature curve of the oxidation step can be rapidly increased without detrimental effects to the final carbon fiber product because the fusion temperature of the PAN-fiber increases so rapidly. Volatiles are efficiently driven off and polymer crosslinking, which increases fusion temperature, occurs in an extensive fashion. The result is that an oxidized PAN-fiber of high density is attained. Such a fiber is easily carbonized at high temperature to obtain a high strength carbon fiber product. The carbonization step, as such, forms no part of the present invention.

The objective of the oxidation step in the preparation of carbon fibers is to increase the density of the fiber to about 1.4 g/cc. The PAN-fiber, prior to oxidation, has a density of about 1.18 g/cc. If the carbonization step, which is conducted at temperatures of about 1000° C. to 2000° C., is performed on fiber having a density below about 1.4 g/cc, then bubble defects are present due to volatile components. Two factors that contribute to increase in density of the fiber during the oxidation step are: removal of volatile components and crosslinking of the polyacrylonitrile polymer.

A requirement for a more efficient oxidation step in the process for preparing carbon fibers is the formation of crosslinks in the precursor polyacrylonitrile copolymer. The sticking temperature of the copolymer is raised in proportion to the number of crosslinks formed in the copolymer. Broadly, the sticking temperature of polymer particles in a fluidized bed is defined as the temperature at which fluidization ceases due to agglomerization of said particles in the bed. A polymer can be inherently sticky due to its chemical or mechanical properties or pass through a sticky phase during the production cycle. The flow factor references the flow of all materials to that of dry sand. On a scale of 1 to 10, dry sand scores a 10. Sticky polymers are usually 1–3, and free flowing polymers are usually 4–10.

In the present process, effective crosslinks are obtained by the use of primary and secondary amines. Increased amounts of carboxylic acid groups in the PAN copolymer allows for retention of more amine crosslinkers. An advantage of the amines is that they leave no residue upon crosslinking. Crosslinking agents containing metal cations such as sodium, potassium or zinc leave a residue after reaction.

TABLE 1

| PAN 1<br>Acrylonitrile<br>Methylmethacrylate<br>Itaconic Acid | PAN 2<br>Acrylonitrile<br>Itaconic Acid | PAN 3<br>Acrylonitrile<br>Itaconic Acid | PAN 4<br>Acrylonitrile<br>Itaconic Acid |
|---|---|---|---|
| 95.4 | 98.5 | 98.5 | 98.5 |
| 3.8 | 1.5 | 1.5 | 1.5 |
| 0.8 | | | |
| 250° C. | 280° C. | 280° C. | 300° C. |
| $Na^+$ | $Na^+$ | $NH_4$+ | $NH_4^+$ |
| 1.3 g/cc | 1.3 g/cc | 1.3 g/cc | 1.3 g/cc |
| 45 min. | 20 min. | 10 min. | 5 min. |
| 1.4 g/cc | 1.4 g/cc | 1.4 g/cc | 1.4 g/cc |
| 90 min. | 40 min. | 20 min. | 9 min. |

Table 1 relates to increase in density of various PAN-fiber copolymers over time. All of the PAN-fibers have an original density of about 1.18 g/cc prior to heating in a first stage of oxidation under crosslinking conditions. Fibers crosslinked in the presence of ammonium ion reach an end point density of 1.4 g/cc more quickly than fibers crosslinked in the presence of sodium ions. Also, fibers prepared from copolymers devoid of neutral monomers such as methyl methacrylate are more readily crosslinked.

TABLE 2

| PAN 1 Acrylonitrile Itaconic Acid 98.5/1.5 | | PAN 2 Acrylonitrile Itaconic Acid 98.5/1.5 | |
|---|---|---|---|
| 1.5 denier* | | 7.0 denier* | |
| 1000 ppm $NH_4^+$ | 1.34 g/cc | 1000 ppm $NH_4^+$ | 1.3 g/cc |
| 2000 ppm $NH_4^+$ | 1.37 g/cc | 2000 ppm $NH_4^+$ | 1.315 g/cc |
| 3000 ppm $NH_4^+$ | 1.4 g/cc | 3000 ppm $NH_4^+$ | 1.33 g/cc |
| 4000 ppm $NH_4^+$ | 1.43 g/cc | 4000 ppm $NH_4^+$ | 1.35 g/cc |

*250° C., 90 MINUTES IN AIR

Table 2 relates to increase in density of two PAN-fibers which differ only in surface area (denier). Both fibers are prepared from a polymer containing acrylonitrile monomer and itaconic acid monomer in a ratio of 98.5 wt. % to 1.5 wt. %. Both fibers are heated in air at 250° C. for a time of about 90 minutes in the presence of various amounts of ammonium ion crosslinker. The original density of both fibers is 1.18 g/cc and increases with time of heating. Increase in density depends upon amount of ammonium ion present and surface area of the fiber. A fiber with a large surface area is much more difficult to crosslink.

FIG. 1 is a graph showing the increase in sticking temperature of four separate fibers based on minutes of heating during the oxidation stage. Rapid increase in sticking temperature of the fiber allows for a smooth and efficient and swift oxidation stage. Ammonium ion content of the PAN-fiber determines the rate of increase in sticking temperature.

Plot 3 represents the rapid increase in sticking temperature for a PAN-fiber prepared from 2.5 wt. % itaconic acid monomer and 97.5 wt. % acrylonitrile monomer. The fiber retains 2.1 mole % ammonium ion crosslinker. The fiber is heated at a constant temperature of 280° C. to obtain a sticking temperature of 400° C. in less than 4 minutes.

Plot 1 represents a less rapid but still dramatic increase in sticking temperature for a PAN-fiber prepared from 1.5 wt. % itaconic acid monomer and 98.5 wt. % acrylonitrile monomer. The fiber retains 1.2 mole % ammonium ion crosslinker. The fiber is heated at a constant temperature of 280° C. to obtain a sticking temperature of 400° C. in less than 8 minutes.

If ammonium ion is completely replaced with sodium ion, then the rate of increase of sticking temperature upon heating is substantially decreased. Plot 2 represents a PAN-fiber having the same composition as the fiber of plot 1. Ammonium ion content has been reduced to zero and replaced with sodium ion. After 20 minutes of heating at a sustained temperature of 280° C., the sticking temperature of the PAN-fiber as represented by plot 2 is only 400° C.

Plot 4 represents a commercial grade of PAN-fiber which is prepared from 0.8 wt. % itaconic acid monomer, 3.8 wt. % methyl methacrylate comonomer and 95.4 wt. % acrylonitrile monomer. Neutral comonomers such as methyl methacrylate inhibit the rapid rise in sticking temperature, thus slowing the oxidation reaction. If neutral comonomers are present in an amount greater than 2.0 wt. %, rapid rise in sticking temperature is severely restricted due to lowering of the softening point of the PAN-fiber. Plot 4 shows the slow rise in sticking temperature for a PAN-fiber having neutral comonomer in an amount greater than 2.0 wt. % and in the absence of ammonia or amine crosslinker. After 20 minutes of heating at a sustained temperature of 250° C., the sticking temperature has increased to only 310° C.

Figure 2:
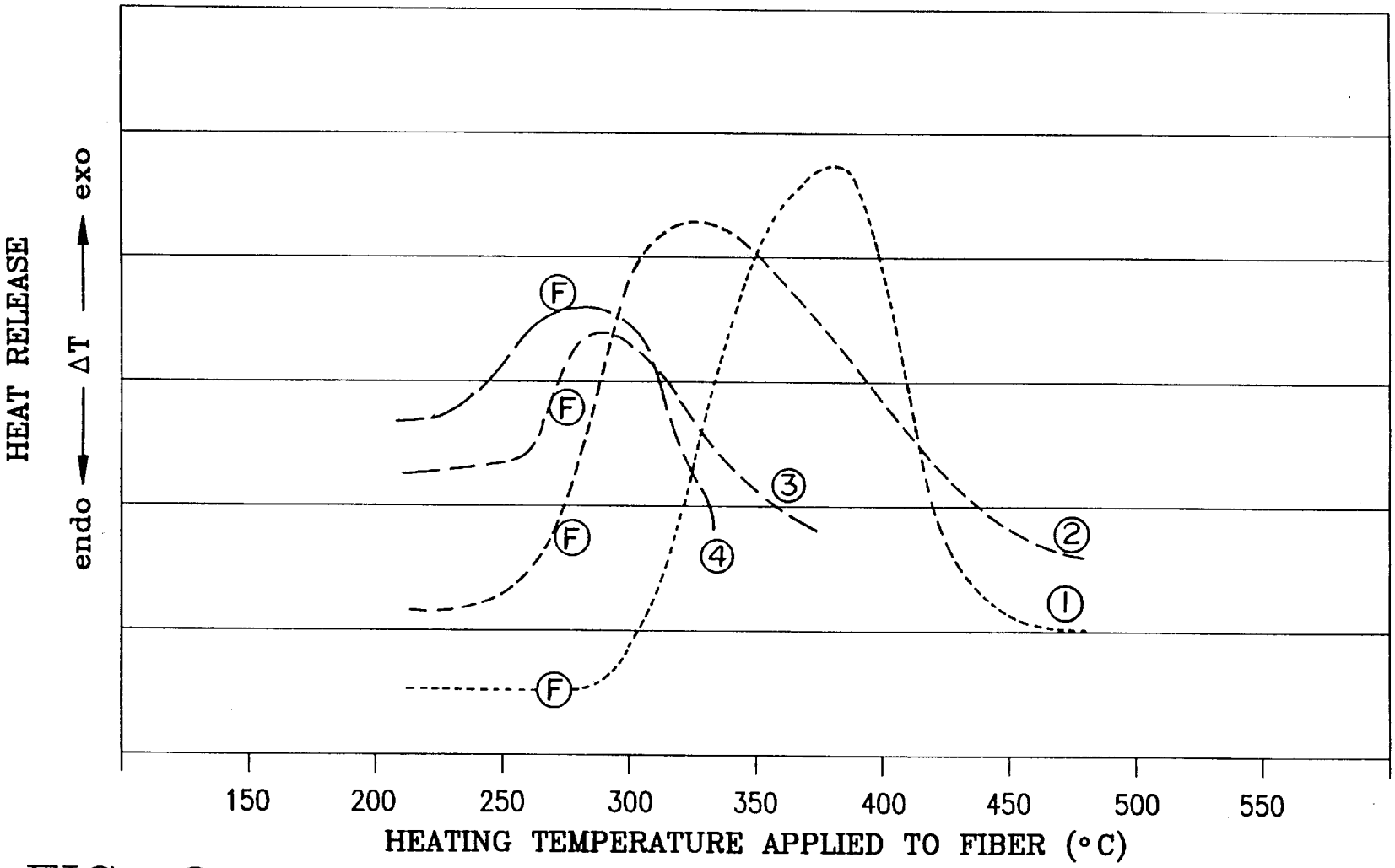
FIG. 2 is a graphical representation (exploded view) of four separate PAN-fibers having substantially the same heat release at about 200° C.

FIG. 2 is an exploded graph of heating temperature applied to fiber versus amount of heat released by the fiber as the fusion temperature is reached or upon initiation of crosslinking and cyclization reactions. An exploded graph refers to a representation of a family of individual curves (plots) which start at substantially the same x,y coordinate position but are displaced (separated) so that overlap will be eliminated to a large degree. Four PAN-fibers having different amounts of ammonium ion crosslinker are illustrated. The graph illustrates results of a differential thermal analysis on a 5 mg sample at a steady temperature rise of 20° C. per minute in air.

Plot 1 represents a PAN copolymer fiber prepared from 1.0 wt. % itaconic acid monomer and 99.0 wt. % acrylonitrile monomer. The fiber retains 1.2 mole % sodium ion and is devoid of ammonium ion crosslinker. As is readily apparent in the graph, the fusion temperature, which can be defined as the temperature of a brass surface that causes fibers to stick to it, is reached before the initiation of the crosslinking reaction. Once the fusion temperature of the copolymer is reached (about 280° C.), heat release of the copolymer skyrockets to extremely high exothermic conditions. Rapid release of volatiles leads to poor physical properties in the carbon fiber product.

Plot 2 represents a PAN copolymer fiber prepared from 1.0 wt. % itaconic acid monomer and 99.0 wt. % acrylonitrile monomer. The fiber retains 1.2 mole % ammonium ion crosslinker. The fusion temperature is reached after the initiation of the crosslinking reaction. Because of the relatively low amount of ammonium ion retained by the copolymer, heat release of the copolymer climbs rapidly to high exothermic conditions once the fusion temperature is reached.

Plot 3 represents a PAN copolymer fiber prepared from 2.4 wt. % itaconic acid monomer and 97.6 wt. % acrylonitrile monomer. The fiber retains 2.0 mole % ammonium ion crosslinker. Crosslinking is initiated at a temperature well below the fusion temperature; and the heat release at the fusion temperature is not substantially greater than the heat release at initiation of crosslinking. High exothermic conditions are avoided and an excellent carbon fiber precursor is obtained.

Plot 4 represents a PAN copolymer fiber prepared from 4.0 wt. % itaconic acid monomer and 96.0 wt. % acrylonitrile monomer. The fiber retains 3.5 mole % ammonium ion crosslinker. Crosslinking initiated at a temperature well below the fusion temperature; and the heat release at the fusion temperature is not substantially greater than the heat release at initiation of crosslinking. High exothermic conditions are avoided and an excellent carbon fiber precursor is obtained.

Figure 3:
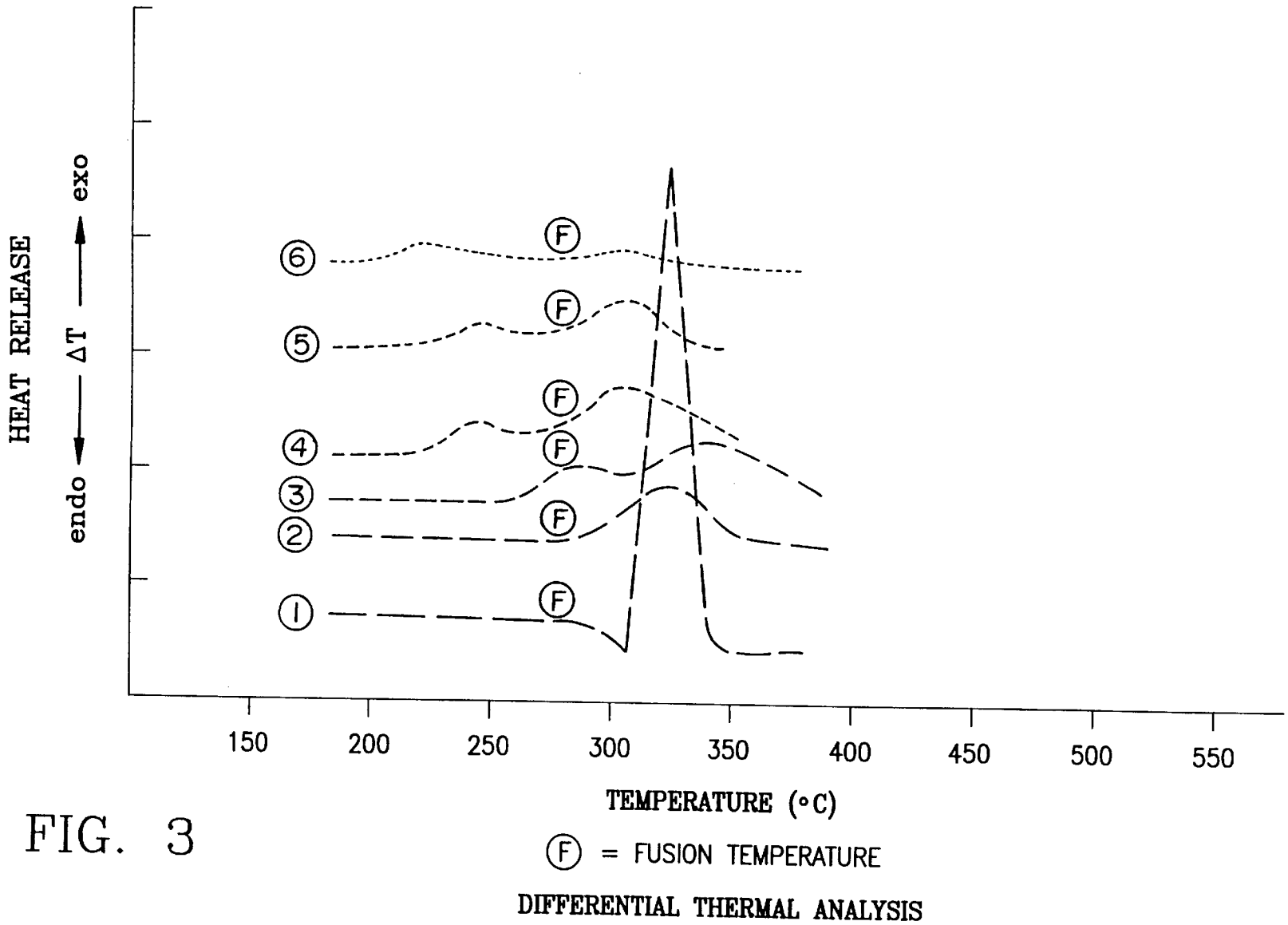
FIG. 3 is a graphical representation (exploded view) of six separate PAN-fibers having substantially the same heat release at about 200° C.

FIG. 3 is an exploded graph of heating temperature applied to fiber versus amount of heat released upon initiation of crosslinking and cyclization reactions. Six PAN-fibers having different amounts of ammonium (or sodium) ions are illustrated. The graph represents results of a differential thermal analysis on a 5 mg sample of six different copolymers at a steady temperature rise of 20° C. per minute in nitrogen.

Plot 1 represents a PAN copolymer fiber prepared from 1 wt. % itaconic acid monomer and 99 wt. % acrylonitrile monomer. The fiber retains 1.2 mole % sodium and is devoid of ammonium ion crosslinker. The fusion temperature is reached before initiation of crosslinking and cyclization. When the fusion temperature is reached (about 280° C.), heat release of the copolymer skyrockets to extremely high exothermic conditions.

Plot 2 represents a PAN copolymer fiber prepared from 1 wt. % itaconic acid monomer and 99 wt. % acrylonitrile monomer. The fiber retains 0.6 mole % sodium and 0.6 mole % ammonium ion crosslinker. The fusion temperature is reached at about the time of the initiation of crosslinking reaction. When fusion temperature is reached (about 280° C.), heat release of the copolymer increases, but not dramatically.

Plot 3 represents a PAN copolymer fiber prepared from 1 wt. % itaconic acid monomer and 99 wt. % acrylonitrile monomer. The fiber retains 0.4 mole % sodium ion and 0.8 mole % ammonium ion crosslinker. The fusion temperature is reached after the initiation of the crosslinking reaction. When the fusion temperature is reached (about 280° C.), heat release of the copolymer increases, but not dramatically.

Plot 4 represents a PAN copolymer fiber prepared from 1 wt. % itaconic acid monomer and 99 wt. % acrylonitrile monomer. The fiber retains 1.2 mole % ammonium ion crosslinker. The fusion temperature is reached after the initiation of crosslinking and cyclization. When the fusion temperature is reached (about 280° C.), heat release of the copolymer increases, but not dramatically.

Plot 5 represents a PAN copolymer fiber prepared from 2.4 wt. % itaconic acid monomer and 97.6 wt. % acrylonitrile monomer. The fiber retains 2.0 mole % ammonium ion crosslinker. The fusion temperature is reached after the initiation of crosslinking and cyclization. When the fusion temperature is reached (about 280° C.), heat release of the copolymer increases, but not dramatically.

Plot 6 represents a PAN copolymer fiber prepared from 4 wt. % itaconic acid monomer and 96 wt. % acrylonitrile monomer. The fiber retains 3.5 mole % ammonium ion crosslinker. The fusion temperature is reached after the initiation of crosslinking and cyclization. When the fusion temperature is reached (about 280° C.), heat release of the copolymer increases only slightly.

Figure 4:
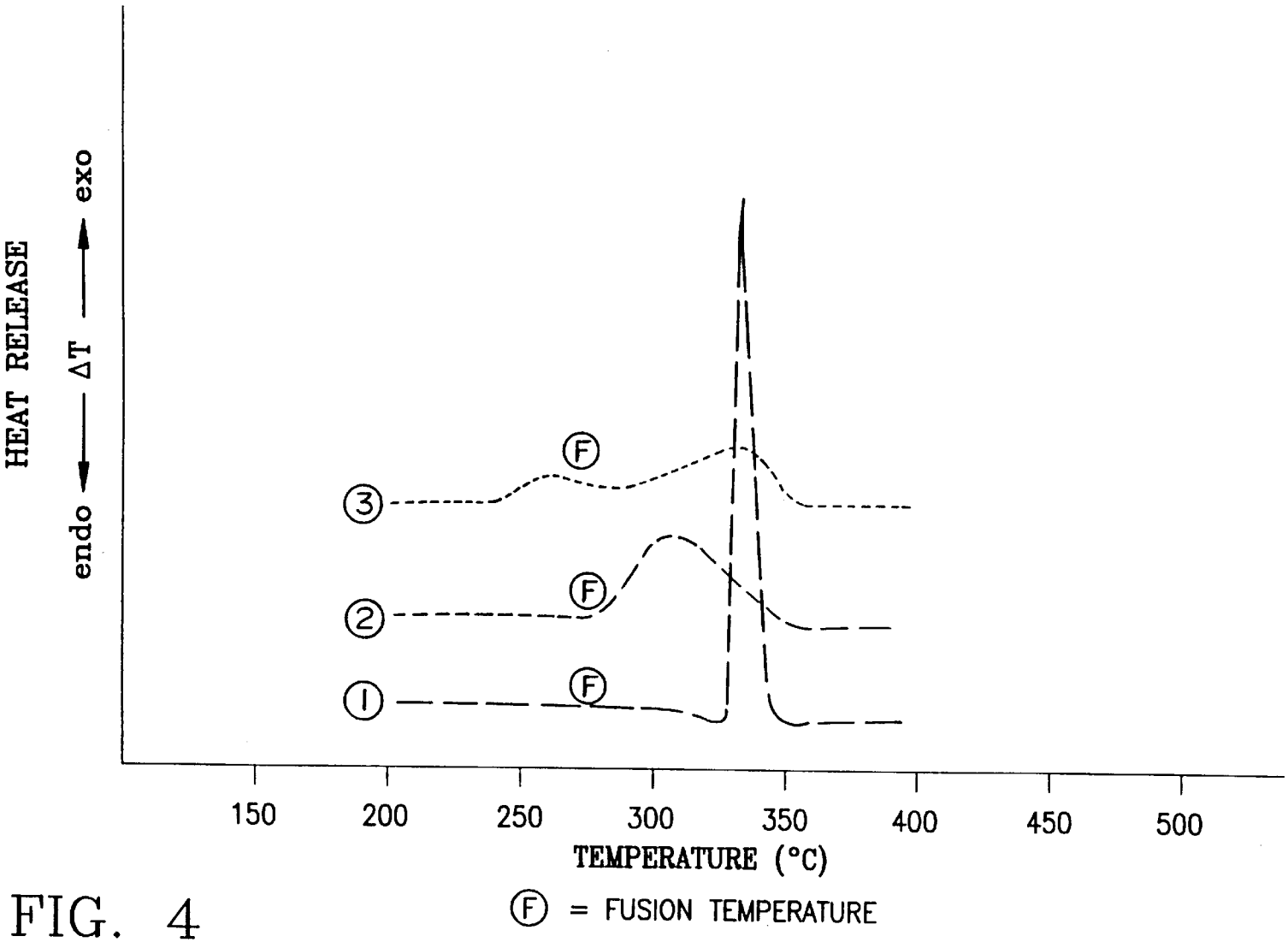
FIG. 4 is a graphical representation (exploded view) of three separate PAN-fibers having substantially the same heat release at about 200° C.

FIG. 4 is an exploded graph of heating temperature applied to fiber versus amount of heat released upon initiation of crosslinking and cyclization reactions. Three PAN-fibers having different amounts of ammonium (or sodium) ions are illustrated. The graph represents results of a differential thermal analysis on a 5 mg sample of three different copolymers at a steady temperature rise of 20° C. per minute in nitrogen.

Plot 1 represents a PAN copolymer fiber prepared from 1 wt. % itaconic acid monomer and 99 wt. % acrylonitrile monomer. The fiber retains 1.2 mole % sodium ion. The fusion temperature of the fiber is reached before the initiation of crosslinking and cyclization. When the fusion temperature is reached (about 280° C.), heat release of the fiber increases substantially in less than one minute. This type of fiber demands a very slow heating cycle in order to obtain useful physical properties.

Plot 2 represents a PAN copolymer fiber prepared from 0.8 mole % itaconic acid as free acid, 3.8 mole % methyl acrylate as neutral monomer, and 95.4 mole % acrylonitrile monomer. No amine, ammonium or sodium ion is present. Crosslinking and cyclization begins near the time the fusion temperature is reached, and heat is released from the fiber in about 4 minutes. These results are due to the presence of a neutral monomer and the poor crosslinking effect of hydrogen ion (present in the free acid).

Plot 3 represents a PAN copolymer fiber prepared from 1 wt. % itaconic acid monomer and 99 wt. % acrylonitrile monomer. The fiber retains 1.2 mole % ammonium ion crosslinker. The initiation of crosslinking and cyclization is reached before the fusion temperature of the fiber. When the fusion temperature of the fiber is reached (about 280° C.), there is no dramatic release of heat. Heat is released over a period of about 7 minutes. With a PAN copolymer of this structure, the heating cycle can be fast and economical.

TABLE 3

| | (me/kg) Amine Content | (wt. %) Monomer Acid Content in Polymer |
|---|---|---|
| Itaconic Acid | 150 | 1.0 |
| Itaconic Acid | 300 | 2.0 |
| Itaconic Acid | 475 | 3.0 |
| Itaconic Acid | 610 | 4.0 |
| Itaconic Acid | 780 | 5.0 |
| Acrylic Acid | 140 | 1.0 |
| Acrylic Acid | 290 | 2.0 |
| Acrylic Acid | 410 | 3.0 |
| Acrylic Acid | 560 | 4.0 |
| Acrylic Acid | 695 | 5.0 |
| Methacrylic Acid | 110 | 1.0 |
| Methacrylic Acid | 240 | 2.0 |
| Methacrylic Acid | 350 | 3.0 |
| Methacrylic Acid | 480 | 4.0 |
| Methacrylic Acid | 590 | 5.0 |
| AMPS | 50 | 1.0 |
| AMPS | 100 | 2.0 |
| AMPS | 150 | 3.0 |
| AMPS | 200 | 4.0 |
| AMPS | 250 | 5.0 |

Table 3 discloses the weight % acid monomer content required to retain milliequivalents per kilogram of amine crosslinker in four different PAN copolymers. The amine can be a primary or secondary amine which has a -log $K_b$<5, where $K_b$ is defined as the equilibrium constant for the reversible dissociation of a weak electrolyte (Lange's Handbook of Chemistry). Examples of such amines are: methyl amine, dimethyl amine, ethyl amine, diethyl amine, propyl amine, dipropyl amine, n-butyl amine, di-(n-butyl)amine, and the like. The PAN copolymer which can retain the greatest amount of amine crosslinker with least effect on fusion temperature is the copolymer containing itaconic acid. The PAN copolymer containing acrylic acid ranks second in retention of amine. The third most retentive PAN copolymer is the one containing methacrylic acid. The least retentive PAN copolymer is the one containing as comonomer acrylamido-2-methylpropane sulfonic acid (AMPS).

TABLE 4

| | Monomer Acid Content in Polymer (wt. %) | Amine Content (mole %) |
|---|---|---|
| Itaconic Acid | 1.0 | .80 |
| Itaconic Acid | 2.0 | 1.6 |
| Itaconic Acid | 3.0 | 2.45 |
| Itaconic Acid | 4.0 | 3.3 |
| Acrylic Acid | 1.0 | .75 |
| Acrylic Acid | 2.0 | 1.5 |

TABLE 4-continued

| | Monomer Acid Content in Polymer (wt. %) | Amine Content (mole %) |
|---|---|---|
| Acrylic Acid | 3.0 | 2.25 |
| Acrylic Acid | 4.0 | 3.0 |
| Methacrylic Acid | 1.0 | 0.6 |
| Methacrylic Acid | 2.0 | 1.25 |
| Methacrylic Acid | 3.0 | 1.85 |
| Methacrylic Acid | 4.0 | 2.5 |
| AMPS | 1.0 | 0.25 |
| AMPS | 2.0 | 0.5 |
| AMPS | 3.0 | 0.75 |
| AMPS | 4.0 | 1.1 |

Table 4 represents an analysis similar to that represented in Table 3, except that the amount of amine is given in mole %, rather than milliequivalents per kilogram. Once again, the amine crosslinker can be a primary or secondary amine which has a -log $K_b$<5. And, again, the PAN copolymer which retains the greatest amount of amine with least effect on fusion temperature is the copolymer containing itaconic acid monomer. Following in order are the PAN copolymers containing acrylic acid monomer, methacrylic acid monomer and AMPS (acrylamido-2-methylpropane sulfonic acid).

While the invention has been described by specific examples and embodiments, there is no intent to limit the inventive concept except as set forth in the following claims.

I claim:

1. A process for preparing an oxidized precursor for a carbon fiber of high strength comprising the steps of:

(a) obtaining an extruded fiber comprising a substantially metal-free, substantially vinyl-sulfonic acid monomer-free polyacrylonitrile copolymer wherein the copolymer is prepared from acrylonitrile in an amount of about 95% to about 98% based on weight, a vinyl carboxylic acid monomer in an amount sufficient to retain in the copolymer ammonium ion or amine catalyst in an amount of about 1% to about 4% based on molar ratio, and optionally a vinyl carboxylic acid ester monomer in an amount up to about 2% based on weight;

(b) adding to the fiber an oxidation catalyst which is a member selected from the group consisting of ammonia and low molecular weight amines;

(c) washing, drying and stretching the fiber to form a precursor;

(d) removing the precursor to an oxidation zone;

(e) heating the precursor at a temperature below the fusion temperature of said precursor for a time sufficient to initiate crosslinking reactions between the ammonium ion or amine catalyst and pendant cyano groups of the copolymer;

(f) increasing the heating in subsequent stages, as the fusion temperature of the precursor increases, to a temperature of about 400° C. for a time sufficient to increase the fiber density to about 1.40 g/cc; and (g) withdrawing the oxidized precursor from the oxidation zone.

2. A process according to claim 1 further comprising the steps of:

(h) passing the oxidized precursor to a carbonization zone;

(i) carbonizing the oxidized precursor at a temperature of about 1000° C. to about 2000° C. in an inert atmosphere for a time of about 1 to about 5 minutes; and (j) withdrawing a carbon fiber.

3. A process according to claim 1 wherein the vinyl carboxylic acid monomer is a member selected from the group consisting of acrylic acid, methacrylic acid, itaconic acid, p-vinyl benzoic acid, and m-vinyl benzoic acid.

4. A process according to claim 1 wherein the vinyl carboxylic acid ester monomer is a member selected from the group consisting of $C_1$–$C_4$ esters of methacrylic acid and vinyl acetate.

5. A process according to claim 1 wherein the amine catalyst is a member selected from the group consisting of methyl amine, ethyl amine, propyl amine, butyl amine, dimethyl amine, diethyl amine, dipropyl amine and dibutyl amine.

6. A process according to claim 3 wherein the vinyl carboxylic acid monomer is itaconic acid.

7. A process according to claim 1 wherein the heating of step (f) is conducted for a time of about 8 minutes to about 20 minutes.

8. A process according to claim 1 wherein the amount of vinyl carboxylic acid in the copolymer is about 2% to 8% based on weight.

* * * * *